US008167036B2

(12) United States Patent
Pfefferle

(10) Patent No.: US 8,167,036 B2
(45) **Date of Patent: *May 1, 2012**

(54) METHOD FOR IN-SITU COMBUSTION OF IN-PLACE OILS

(75) Inventor: William C. Pfefferle, Madison, CT (US)

(73) Assignee: Precision Combustion, Inc., North Haven, CT (US)

( * ) Notice: Subject to any disclaimer, the term of this patent is extended or adjusted under 35 U.S.C. 154(b) by 129 days.

This patent is subject to a terminal disclaimer.

(21) Appl. No.: 12/462,079

(22) Filed: Jul. 29, 2009

(65) Prior Publication Data

US 2009/0321073 A1 Dec. 31, 2009

Related U.S. Application Data

(63) Continuation-in-part of application No. 11/646,002, filed on Dec. 27, 2006, now Pat. No. 7,581,587.

(60) Provisional application No. 60/756,020, filed on Jan. 3, 2006.

(51) Int. Cl.
*E21B 43/243* (2006.01)
*E21B 43/30* (2006.01)

(52) U.S. Cl. ..... 166/245; 166/256; 166/257; 166/261; 166/272.1; 166/272.7; 166/306

(58) Field of Classification Search ..... None
See application file for complete search history.

(56) References Cited

U.S. PATENT DOCUMENTS

| | | | | |
|---|---|---|---|---|
| 1,269,747 | A | 6/1918 | Rogers | 299/2 |
| 3,223,166 | A | 12/1965 | Hunt et al. | 166/300 |
| 3,244,231 | A | 4/1966 | Grekel | 166/300 |
| 3,548,938 | A | 12/1970 | Parker | 166/256 |
| 3,565,174 | A | 2/1971 | Parker et al. | 166/261 |
| 3,804,163 | A | 4/1974 | Bradley et al. | 166/59 |
| 3,817,332 | A | 6/1974 | Berry et al. | 166/302 |
| 3,980,137 | A | 9/1976 | Gray | 166/256 |
| 4,026,357 | A * | 5/1977 | Redford | 166/261 |
| 4,043,393 | A | 8/1977 | Fisher et al. | 166/248 |
| 4,169,506 | A | 10/1979 | Berry | 166/256 |
| 4,237,973 | A | 12/1980 | Todd | 166/59 |
| 4,384,613 | A | 5/1983 | Owen et al. | 166/256 |
| 4,397,356 | A | 8/1983 | Retallick | 166/303 |
| 4,410,042 | A * | 10/1983 | Shu | 166/261 |
| 4,415,031 | A * | 11/1983 | Hunt, III | 166/261 |
| 4,662,443 | A | 5/1987 | Puri et al. | 166/261 |
| 4,687,491 | A | 8/1987 | Latty | 44/301 |
| 5,163,511 | A | 11/1992 | Amundson et al. | 166/303 |
| 5,211,230 | A | 5/1993 | Ostapovich | 166/245 |
| 5,217,076 | A | 6/1993 | Masek | 166/303 |
| 5,339,897 | A | 8/1994 | Leaute | 166/245 |
| 5,456,315 | A | 10/1995 | Kisman et al. | 166/245 |
| 5,626,191 | A | 5/1997 | Greaves et al. | 166/245 |
| 6,016,868 | A | 1/2000 | Gregoli et al. | 166/261 |
| 6,358,040 | B1 | 3/2002 | Pfefferle et al. | 431/7 |
| 6,394,791 | B2 | 5/2002 | Smith et al. | 431/170 |
| 6,973,968 | B2 | 12/2005 | Pfefferle | 166/260 |

(Continued)

*Primary Examiner* — George Suchfield

(74) *Attorney, Agent, or Firm* — Robert L. Rispoli

(57) ABSTRACT

A novel method is provided for in situ combustion and recovery of oil from underground reservoirs including injecting oxygen into the reservoir at a region near the reservoir floor, establishing a combustion front wherein hot combustion gases rise at the combustion front, withdrawing hot combustion gases from a region near the reservoir ceiling, and extracting oil from a horizontal production well near the reservoir floor.

10 Claims, 3 Drawing Sheets

U.S. PATENT DOCUMENTS

| | | | | |
|---|---|---|---|---|
| 7,343,971 | B2 | 3/2008 | Pfefferle | 166/260 |
| 7,476,367 | B2 | 1/2009 | Etemad et al. | 422/211 |
| 7,493,952 | B2 * | 2/2009 | Ayasse | 166/261 |
| 7,581,587 | B2 * | 9/2009 | Pfefferle | 166/245 |
| 7,665,525 | B2 | 2/2010 | Pfefferle | 166/303 |
| 2005/0239661 | A1 | 10/2005 | Pfefferle | 507/100 |
| 2007/0119350 | A1 | 5/2007 | McWhorter | 110/323 |
| 2009/0308606 | A1 * | 12/2009 | Ayasse | 166/261 |

* cited by examiner

FIGURE 1 – PRIOR ART

METHOD FOR IN-SITU COMBUSTION OF IN-PLACE OILS

CROSS-REFERENCE

This application is a continuation-in-part, and claims the benefit of, U.S. patent application Ser. No. 11/646,002; now U.S. Pat. No. 7,581,587; filed on Dec. 27, 2006; which application in turn claims the benefit of U.S. Provisional Application No. 60/756,020; filed on Jan. 3, 2006; both of which are incorporated herein in their entirety.

FIELD OF THE INVENTION

This invention relates to a method for contacting carbonaceous deposits in a sub-surface formation with a reactive fluid whereby such deposits may be mobilized thus allowing for recovery. More specifically, the invention relates to a method for efficient recovery and upgrading of heavy oils.

BACKGROUND OF THE INVENTION

In-situ combustion is an established method for enhanced oil recovery. In a typical application, air is injected into a vertical well resulting in combustion and increased oil mobility. Product oil is then recovered via either the injection well by a process known as "huff-and-puff" or via a second vertical well. The process is not widely used because it has been difficult to control. Thus, attempts have been made to improve the process.

To reduce the problem of gravity segregation, for example, air is injected at a high point of the reservoir. U.S. Pat. No. 5,211,230 to Ostapovich discloses injecting air at a high point of the reservoir via a vertical well along with a lower horizontal production well. U.S. Pat. No. 5,626,191 to Greaves discloses placing the low horizontal well perpendicular to the vertical well to draw the combustion front along the horizontal well and away from the injection well. Although this is an improvement, combustion products are intended to be removed with the heated oil and thus injected fresh air also has ready access to the horizontal well between the toe and the combustion front. A further disadvantage is that the injection well and the horizontal well vertical leg must be located far apart. Accordingly, there is still a need for a process which is controllable and provides efficient use of injected air.

It is an object of the present invention to provide an improved method of contacting an injected fluid with a reaction front whereby oil may be recovered economically. It is a further object of the present invention to enable more efficient in-situ combustion of in-place heavy oil whereby combustion products are more efficiently removed from the combustion zone and thermal cracking is promoted.

SUMMARY OF THE INVENTION

Applicant's prior invention disclosed in U.S. patent application Ser. No. 11/646,002; now U.S. Pat. No. (TBD), air is injected near the reservoir floor allowing the hot combustion products to over-ride the cooler fresh oxygen containing gas. The cooler gas is thus drawn to the combustion front aided by withdrawal of combustion products via a bleed well located at a point well above the reservoir floor. Use of a horizontal bleed well permits steering of combustion front travel. Advantageously, oil is recovered via a horizontal production well having its heel (the transition from horizontal to vertical rise to the surface) near the injection well. This means that the production well can be maintained liquid full throughout the air-rich burned out zone blocking loss of injected air.

It has now been found that high purity oxygen offers additional advantages such as allowing higher temperatures for cracking of heavy oils. In a further improvement, oxygen diluted with carbon dioxide is used instead of pure oxygen, thus promoting easier flow of product oil to the production well.

Combustion product gases may be withdrawn from a region near the top of the reservoir, preferably at an elevated pressure near the reservoir pressure. Passage of the withdrawn hot combustion gases through an expansion turbine allows recovery of a portion of the energy required for compression of the injection gases. Combustion of fuel to utilize oxidant in the withdrawn hot combustion gases to further heat the hot combustion gases increases power output of the power turbine. Fresh air may be added as necessary to combust fuel values present in the combustion products.

An advantage of the present invention is that the oil recovery well(s) may be drilled from the same platform as the injection and bleed wells thereby reducing the environmental impact. Multiple production wells may be utilized depending upon the reservoir geometry. Typically, it will be advantageous to place the injection well at a low point in the reservoir. In addition, the required wells need not terminate directly under the production platform. If desired, injection and production wells may be drilled from separate platforms located some distance apart with the production well toe (i.e., horizontal terminus) located near the injection well.

DESCRIPTION OF THE INVENTION

Figure 1:
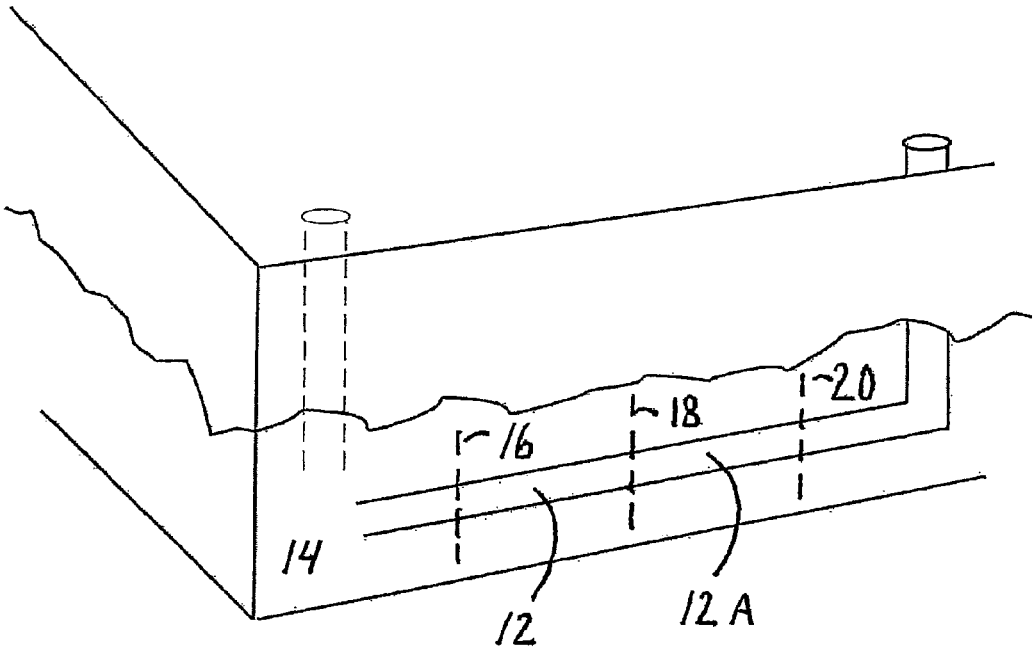
FIG. 1 provides a schematic representation of a prior art system similar to that disclosed in of U.S. Pat. No. 5,626,191.

FIG. 1 depicts an advanced design in-situ combustion system of the prior art. Unlike the system of the present invention, excess combustion gases are withdrawn via the horizontal production well 12. Thus, the horizontal section 12A of well 12 that lies within burned out zone 14 cannot withdraw combustion gases without preferentially bleeding off injected air. As the combustion front progresses from location 16 through representative locations 18, 20, etc., loss of fresh combustion air worsens. To minimize fresh air loss, the toe section may be at a lower elevation than the heel so that the leg between the toe and the combustion front remains liquid full. This also allows oil to drain out of the toe into the reservoir. Even so, this is only a partial solution since hot gases will still tend to over-ride the cooler fresh air at the withdrawal point. The result is energy loss.

Figure 2:
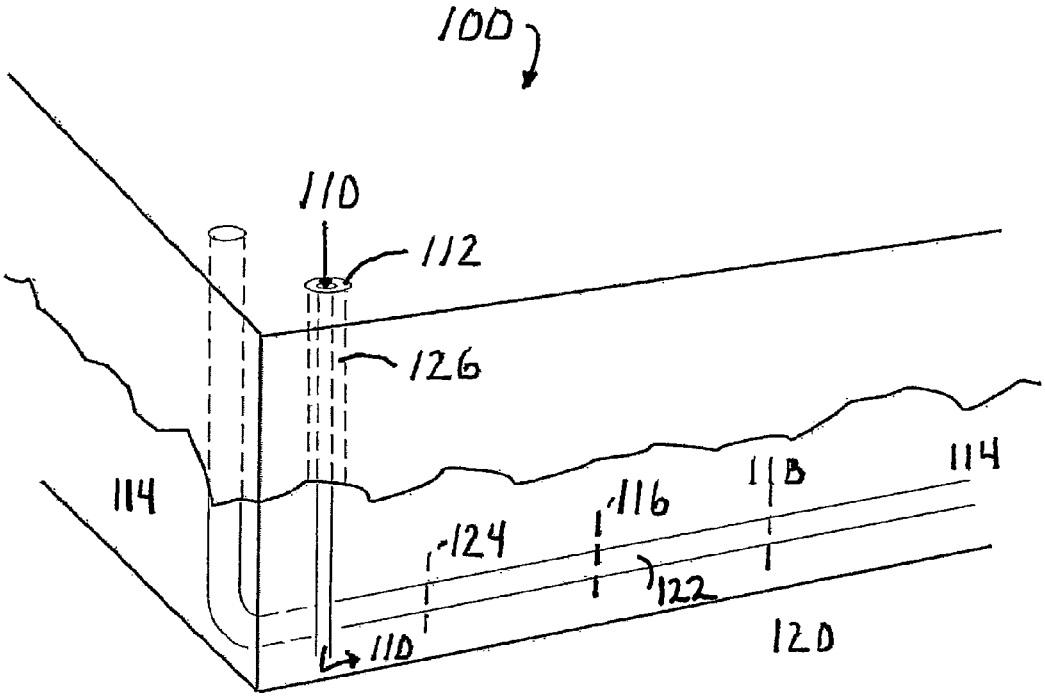
FIG. 2 provides a schematic representation of the present invention.

FIG. 2 depicts a well pattern 100 for in-situ combustion according to the present invention. Oxygen 110 is injected via injection well 112 at the bottom of reservoir 114, also referred to as the reservoir floor, and then flows to combustion front 116. In one embodiment of the invention, carbon dioxide may be mixed with the injected oxygen. Heated oil 118 drains to the reservoir floor on rock bed 120 and is withdrawn at a controlled rate such that horizontal well 122 is liquid full throughout burned out zone 124. Hot combustion gases rise at combustion front 116 and combustion progresses from heel to toe. The hot combustion gases are withdrawn from a region near the reservoir ceiling via concentric well 126 for energy recovery in a turbine (not shown). Well 126 need not be concentric with injection well 112 and may be located as the reservoir structure dictates or may be a horizontal well. As the hot combustion gases are withdrawn from a region near the reservoir ceiling, heated oil drains to the reservoir floor for collection and extraction, typically from a horizontal production well. In a preferred embodiment of the invention, the horizontal production well defines a heel proximate to the injection well, and the toe of the production well is at a higher elevation than the heel.

As stated hereinabove, in the present invention oxygen is injected near the reservoir floor and flows to the combustion front. This feature is aided by the withdrawal of the hot combustion gases via a bleed well located at a point well above the reservoir floor. Use of a horizontal bleed well, preferably located above an oxygen injection well flow exit, permits steering of combustion front travel and oil is recovered via a horizontal production well having its heel near the injection well. In addition, the bleed well may include a horizontal section positioned substantially perpendicular to a vertical injection well, and the hot combustion gases may be withdrawn through multiple bleed wells. Again, this means that the production well can be maintained liquid full throughout the air-rich burned out zone blocking loss of injected air. In a preferred embodiment of the invention, the production well is positioned substantially horizontally, the injection well is positioned substantially vertically, and the production well is positioned substantially perpendicular to the injection well.

Figure 3:
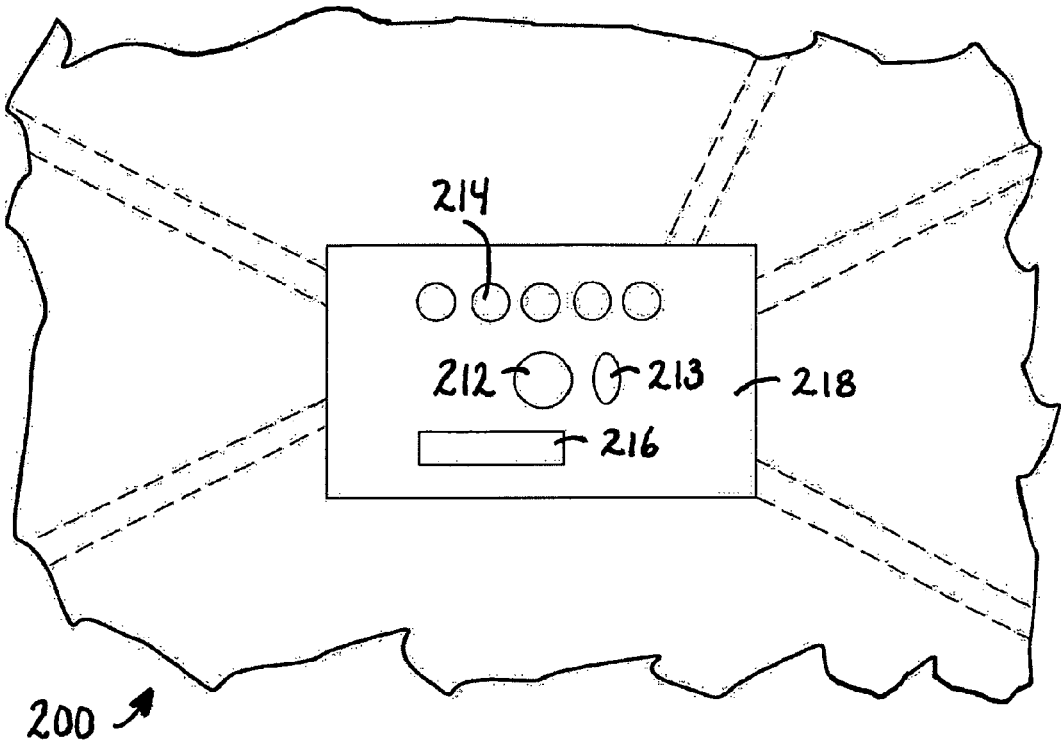
FIG. 3 provides a diagram illustrating a platform with injection and bleed wells along with multiple production wells.

It is advantageous to drill all wells from a common platform, or a single platform. FIG. 3 provides a diagram illustrating a well pattern 200 for in-situ combustion according to the present invention with an injection well 212 and bleed well 213 along with multiple production wells 214. Additional operating equipment 216 also may be present. This diagram demonstrates the minimal surface disturbance required on a platform 218 by the present invention.

While the present invention has been described in considerable detail, other configurations exhibiting the characteristics taught herein for a method for in-situ combustion of in-place oils are contemplated. Therefore, the spirit and scope of the invention should not be limited to the description of the preferred embodiments described herein.

The invention claimed is:

1. A method for in-situ combustion for recovery of oil from an underground reservoir comprising:

a) injecting oxygen into the reservoir via an injection well in a region near the reservoir floor;

b) establishing a combustion front wherein hot combustion gases rise at the combustion front with combustion progressing from heel to toe;

c) withdrawing the hot combustion gases from a region near the reservoir ceiling whereby heated oil drains to the reservoir floor; and d) extracting oil from a horizontal production well near the reservoir floor whereby the horizontal production well defines a heel proximate to the injection well.

2. The method of claim 1 wherein the hot combustion gases are withdrawn through a bleed well located above an oxygen injection well flow exit.

3. The method of claim 2 wherein the bleed well includes a horizontal section positioned substantially perpendicular to the injection well.

4. The method of claim 1 wherein the withdrawn hot combustion gases are passed to an expansion turbine for energy recovery.

5. The method of claim 4 wherein fuel is combusted to heat the hot combustion gases before expansion.

6. The method of claim 1 wherein the injection well and the production well are drilled from a single platform.

7. The method of claim 1 wherein the toe of the production well is at a higher elevation than the heel.

8. The method of claim 1 wherein the production well is positioned substantially horizontally, the injection well is positioned substantially vertically, and the production well is positioned substantially perpendicular to the injection well.

9. The method of claim 8 wherein the hot combustion gases are withdrawn through multiple bleed wells.

10. The method of claim 1 wherein carbon dioxide is mixed with the injected oxygen.

* * * * *